United States Patent [19]

Francis

[11] 4,199,881

[45] Apr. 29, 1980

[54] BOWLING SHOE GUIDE DEVICE

[76] Inventor: Herbert E. Francis, 6135 Cadet St., Detroit, Mich. 48209

[21] Appl. No.: 889,043

[22] Filed: Mar. 22, 1978

[51] Int. Cl.[2] ..... A43B 5/00

[52] U.S. Cl. ..... 36/130

[58] Field of Search ..... 36/130, 132, 133, 136; 40/2 E

[56] References Cited

U.S. PATENT DOCUMENTS

| | | | |
|---|---|---|---|
| 2,503,586 | 4/1950 | Miller | 36/133 |
| 3,074,184 | 1/1963 | Litak | 36/130 |
| 3,406,469 | 10/1968 | Dani | 36/133 |
| 3,641,687 | 2/1972 | Hibbard et al. | 36/130 |

*Primary Examiner*—Patrick D. Lawson

*Attorney, Agent, or Firm*—Irving M. Weiner; Pamela S. Burt; Melvin Yedlin

[57] ABSTRACT

A bowling shoe guide device which enables a bowler to make quick visual reference to his shoe so as to align himself with respect to the flooring of a bowling alley. The device includes a plurality of sighting arrow members disposed on the upper forward toe portion of a bowling shoe, each being disposed substantially parallel to the longitudinal axis of the bowling shoe. Two of the sighting arrows are relatively spaced apart at a distance equal to the distance between adjacent crevices formed between the longitudinal boards of a conventional bowling alley.

10 Claims, 11 Drawing Figures

BOWLING SHOE GUIDE DEVICE

BACKGROUND OF THE INVENTION

1. Field of the Invention

The present invention relates generally to a bowling shoe guide device for use directly on the upper forward toe portion of a bowling shoe to permit a bowler to properly align his foot with respect to the flooring of a bowling alley, merely by making a visual reference to his bowling shoe.

The terminology "bowling shoe" as employed herein is intended to connote the type of shoe generally used by bowlers and having characteristics which include: a heel fabricated of a non-marking material, such as rubber; a sole fabricated of a material which provides a desired frictional resistance relative to the flooring of a conventional alley; and an upper shoe portion fabricated either of leather or a synthetic material.

More particularly, the present invention provides a device which includes a plurality of sighting arrow members, two of which are relatively spaced apart at a distance equal to the distance between adjacent crevices formed between the longitudinal boards of a conventional bowling alley floor.

2. Description of the Prior Art

Conventional bowling alley construction is such that a plurality of floor boards are disposed side-by-side in a longitudinal manner along the alley. The crevices formed between such floor boards are highly visible, and are equally spaced relative to each other across the lateral extent of the bowling alley.

It is well known in the sport of bowling that the position of a bowler relative to the alley is an extremely important consideration when it is desired to properly deliver the bowling ball to the alley. For example, many bowlers discover one particular lateral position on the bowling alley from which the ball delivery is most effective, such as when they achieve a "strike", knocking all ten pins down with a single ball delivery. It is thus highly important to a bowler when a particularly effective delivery position is discovered, that he be afforded some means for properly and precisely aligning himself in the desired position relative to the bowling alley.

Various prior art attempts have been made to provide a guide device for a bowling shoe which affords the bowler with means for aligning himself relative to the bowling alley. Illustrative of prior art bowling shoe guide devices are: the "SOLE FOR BOWLING SHOE" disclosed in U.S. Pat. No. 3,074,184 issued in 1963 to Litak; the "BOWLING SHOE WITH GUIDE MEANS" disclosed in U.S. Pat. No. 3,228,123 issued in 1966 to Iams; and the "BOWLING SHOES WITH SIGHTING LINE IN TIP" disclosed in U.S. Pat. No. 3,641,687 issued in 1972 to Hibbard et al.

Such prior art guide device attempts, however, have not generally met with wide acceptance amongst bowlers seeking a highly accurate guide device for use on bowling shoes. The prior art attempts have generally failed to provide the extremely accurate aligning means desired by bowlers.

The present invention overcomes the problems attendant prior art bowling shoe guide devices, and at the same time provides a device which employs a minimum of parts and material; is easily employed for use; does not impair the bowler's movements; affords an extremely accurate aligning means; and is inexpensive to manufacture.

SUMMARY OF THE INVENTION

The present invention provides a bowling shoe guide device which includes a plurality of sighting arrow members disposed adjacent the upper forward portion of a bowling shoe. Each of the sighting arrow members is disposed substantially parallel to the longitudinal axis of the bowling shoe, and the heads of the sighting arrow members are directed towards and terminate adjacent the forward upper tip of the bowling shoe. First and second ones of the sighting arrow members are relatively spaced apart at a distance substantially equal to the distance between adjacent crevices formed between the longitudinal boards of a conventional bowling alley.

It is an object of the invention to provide a bowling shoe guide device wherein two sighting arrow members, which are spaced apart a distance equal to the distance between adjacent crevices formed between the longitudinal boards of a bowling alley, may be aligned with any two adjacent crevices on the bowling alley to enable the bowler to properly laterally position himself for delivery of the ball to the alley.

Another object of the invention is to provide a third sighting arrow member disposed substantially adjacent to the center line of the upper forward portion of the bowling shoe, with the two above-described spaced sighting arrow members being disposed symmetrically relative to the third sighting arrow member and relative to the center line of the upper forward portion of the bowling shoe.

Yet another object of the invention is to provide a bowling shoe guide device wherein the sighting arrow members are integrally permanently formed in the upper forward portion of the bowling shoe.

A further object of the invention is to provide a bowling shoe guide device wherein there is provided a guide strip adapted to be removably secured adjacent the upper forward portion of the bowling shoe. The sighting arrow members are disposed on the upper visible surface of the guide strip such that the third arrow member is disposed adjacent the center line of the upper forward portion of the bowling shoe.

Other objects and details of the invention will become apparent from the following detailed description, when read in conjunction with the accompanying drawings.

DETAILED DESCRIPTION

Figure 1:
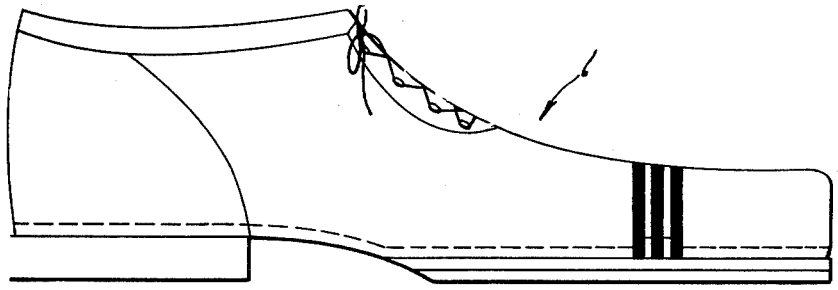
FIG. 1 depicts a side elevational view of a bowling shoe in accordance with a first embodiment of the present invention.
Figure 2:
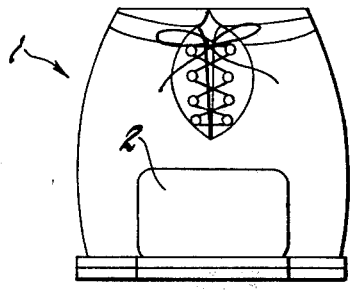
FIG. 2 depicts a front elevational view of a bowling shoe in accordance with a first embodiment of the present invention.

With reference to FIG. 1, there is shown a side view of a bowling shoe 1 for use in accordance with the first embodiment of the invention. As shown in FIG. 2, the bowling shoe 1 includes a square toe portion formed by a flat forward tip surface 2. The flat surface 2 is disposed substantially perpendicular to the longitudinal axis of the bowling shoe 1.

Figure 3:
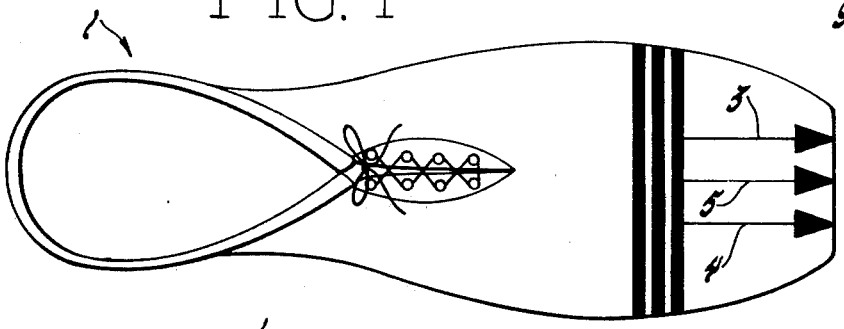
FIG. 3 illustrates a bowling shoe provided with the guide device according to the first embodiment of the invention.

Referring to FIG. 3, the first embodiment of the device according to the invention is illustrated as integrally provided in the upper forward portion of the bowling shoe 1. The device according to the invention includes a plurality of sighting arrow members. More specifically, there is provided three sighting arrow members 3, 4 and 5. The sighting arrow members as shown in FIG. 3 are integrally and permanently formed on the upper forward portion of the bowling shoe 1, such as during manufacture of the shoe. The arrow members 3, 4 and 5 are preferably fabricated of a material similar or identical to the material from which the upper shoe is fabricated, and it is essential that the arrow members be of a contrasting color to the color of the material from which the remainder of the upper shoe is fabricated. For example, if the upper shoe is a light color, then arrow members 3, 4 and 5 should be of a dark color, and vice versa.

The arrow members 3, 4 and 5 extend from their rearward ends disposed adjacent the vamp portion of the shoe 1 to the forward tip of the shoe 1, where the heads of arrow members 3, 4 and 5 terminate adjacent the tip. The arrow members 3, 4 and 5 are directed towards the forward tip of the shoe 1, in the general direction of movement for a bowler wearing the shoe 1.

The arrow members 3 and 4 are disposed in a spaced-apart relation to each other which is critical to the utilization of the present invention. The arrow members 3 and 4 are relatively spaced apart a distance which is substantially equal to the distance between adjacent crevices formed between the longitudinal boards of a conventional bowling alley, the significance of which spacing will be discussed hereinbelow with reference to FIG. 4. The third arrow member 5 is disposed centrally of arrow members 3 and 4 such that arrow members 3 and 4 are symmetrically disposed relative to arrow member 5. Further, arrow member 5 is disposed along the center line of the upper forward portion of bowling shoe 1, the significance of which will be discussed hereinbelow with regard to FIG. 5.

Figure 4:
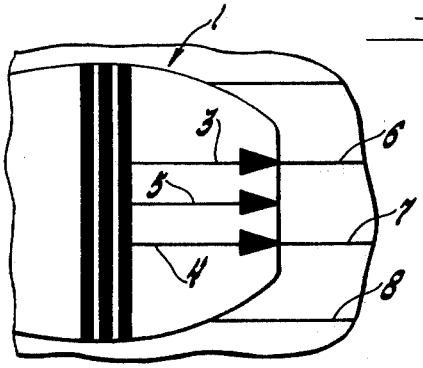
FIG. 4 depicts a portion of the bowling shoe of FIG. 3 shown with respect to a bowling alley during the approaching steps of a bowler.

With reference to FIG. 4, the upper forward portion of bowling shoe 1 having arrow members 3, 4 and 5 disposed thereon is shown in a position relative to the longitudinal floor boards of a bowling alley. In this illustration, two adjacent crevices 6 and 7 formed by the longitudinal boards of the bowling alley are employed in conjunction with arrow members 3 and 4 in utilizing the invention. Because arrow members 3 and 4 are spaced apart a distance equal to the distance between crevices 6 and 7, the bowler can easily align the head of arrow 3 with the crevice 6, and the head of arrow 4 with the crevice 7. Accordingly, the bowler has merely to quickly visually align his shoe relative to crevices 6 and 7 in order to properly align himself in a desired position relative to the alley. It will be understood that crevices 6 and 7 may represent any of the multitude of evenly spaced crevices which are easily visually detectable on the bowling alley.

Figure 5:
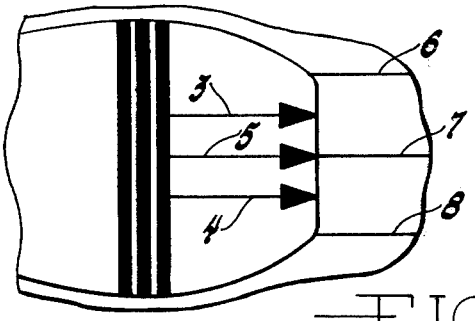
FIG. 5 illustrates a portion of the bowling shoe of FIG. 3 shown with respect to a second position on a bowling alley.

Referring to FIG. 5, an alternate positioning method is illustrated. In this positioning method, the bowler employs the central arrow member 5 rather than the arrow members 3 and 4 in properly aligning his shoe. For example, of the three adjacent crevices 6, 7 and 8 of the bowling alley, the bowler may select crevice 7 and then align the head of center arrow member 5 with crevice 7. Hereagain, any desired one of the multitude of crevices on the bowling alley may be employed for aligning with center arrow member 5.

From the above discussed two aligning methods, it will be understood that the bowler is provided with a very accurate positioning means by virtue of the arrow members 3, 4 and 5. He may selectively align his shoe with the longitudinal axis thereof disposed exactly centrally of a floor board by virtue of arrow members 3 and 4, or alternatively he may align his shoe with the longitudinal axis thereof disposed exactly on one of the crevices of the bowling alley by virtue of center arrow member 5.

Figure 6:
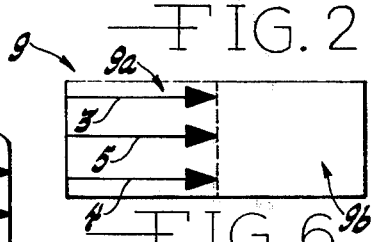
FIG. 6 depicts a guide device in accordance with a second embodiment of the invention.
Figure 7:
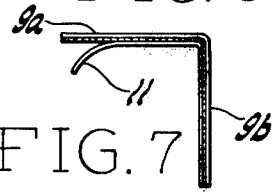
FIG. 7 illustrates the guide device of FIG. 6, shown in a folded position, ready for application to a bowling shoe.

Referring now to FIG. 6, an alternate embodiment of the bowling shoe guide device according to the invention is depicted. A guide strip 9 is provided with a fold line shown in dashed lines. The guide strip 9 is adapted to be folded into a right-angular configuration at the fold line, as shown in FIG. 7. By thus folding guide strip 9, there is provided a substantially horizontal portion 9*a* thereof, and a vertical portion 9*b* thereof. The three sighting arrow members 3, 4 and 5 are disposed on the upper surface of the horizontal portion 9*a* of guide strip 9, and the arrow members are relatively spaced in the same manner as above described with regard to FIGS. 1–5. The heads of arrow members 3, 4 and 5 terminate adjacent the fold line.

The guide strip 9 as shown in FIG. 6 may be formed of any substantially rigid material such as plastic, cardboard, etc., and it should be noted that the arrow members 3, 4 and 5 are of a color which is constrasting to the background color of guide strip 9. For example, arrow members 3, 4 and 5 may be black, with the remainder of guide strip 9 being white, or vice versa.

Figure 8:
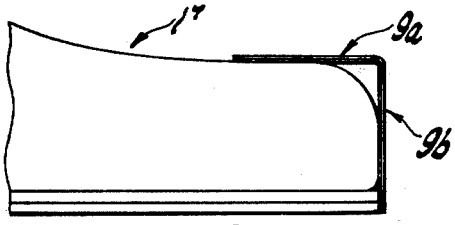
FIG. 8 depicts a side elevational view of a bowling shoe provided with a guide device in accordance with the second embodiment of the invention.
Figure 9:
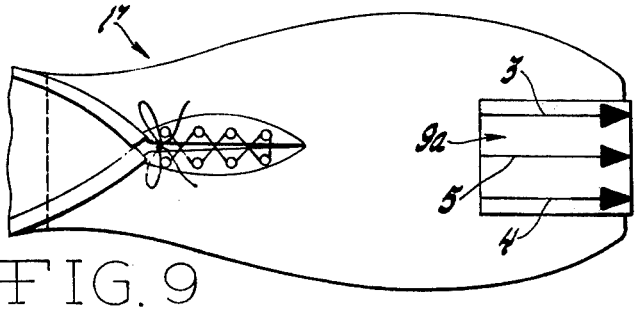
FIG. 9 illustrates a top plan view of the guide device according to the second embodiment of the invention, shown as applied to a bowling shoe.

After guide strip 9 has been bent as shown in FIG. 7, a protective paper backing 11 is removed from the back surface of guide strip 9 to expose an adhesive surface provided with glue or other similar adhesive means. the guide strip 9 is then applied to the bowling shoe 1′ (of the same general construction as shoe 1) as shown in FIGS. 8 and 9, with portion 9*a* being disposed adjacent the upper forward portion of shoe 1′ and portion 9*b* being disposed adjacent the flat forward tip surface of shoe 1′. In positioning guide strip 9 on shoe 1′, the center arrow member 5 is to be disposed substantially adjacent the center line of shoe 1′. In this manner, it will be understood that after guide strip 9 has been adhered to shoe 1′ in the manner described, the three arrow members 3, 4 and 5 will be disposed in the same relative positions as in the above described embodiment of the invention shown in FIGS. 1–5.

Figure 10:
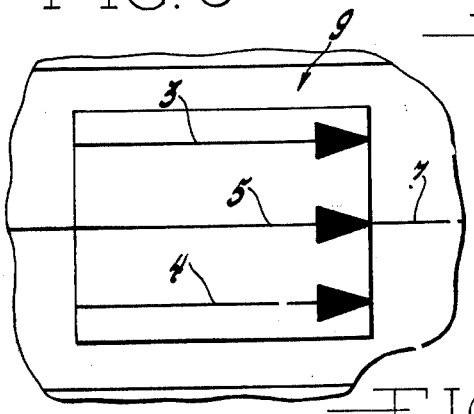
FIG. 10 depicts a first alignment capability of the guide device according to the second embodiment.
Figure 11:
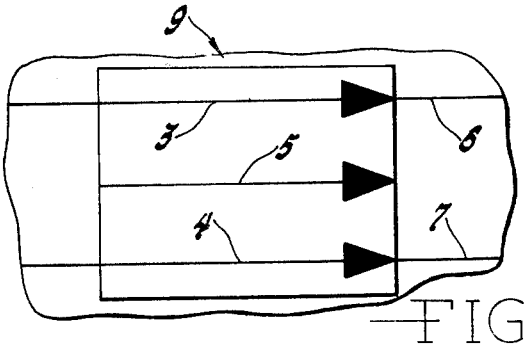
FIG. 11 illustrates a second alignment capability of the guide device according to the second embodiment.

With reference to FIGS. 10 and 11, wherein guide strip 9 (particularly horizontal portion 9*a* thereof) is shown removed from shoe 1' for purposes of clarity, first and second aligning methods are illustrated. In FIG. 10, the center arrow member 5 is employed to align the bowler's shoe with a crevice 7 of the bowling alley, in much the same manner as shown in FIG. 5 with respect to the first embodiment of the invention. In FIG. 11, the outside arrow members 3 and 4 are employed to align the bowler's shoe with two crevices 6 and 7 of the bowling alley, in much the same manner as shown in FIG. 4 with respect to the first embodiment of the invention. It will be understood that the bowler may selectively align his shoe with the longitudinal axis thereof disposed exactly centrally of a floor board by virtue of arrow members 3 and 4, or alternatively he may align his shoe with the longitudinal axis thereof disposed exactly on one of the crevices of the bowling alley by virtue of center arrow member 5, in the same manner as described hereinabove with regard to the embodiment shown in FIGS. 1–5.

With regard to both of the embodiments as above described, it is comtemplated that arrow members 3, 4 and 5 may be generally employed by the bowler to permit him to align his shoe either angularly, or displaced a predetermined distance, relative to the crevices of the bowling alley. The arrow members 3, 4 and 5 thus permit the bowler to align himself relative to positions on the bowling alley each time he is ready to bowl a ball down the alley. Thus, once the bowler has discovered a particular delivery position which is highly effective for him, such as from which he often bowls a strike, the arrow members 3, 4 and 5 permit him to accurately and effectively quickly visually align his foot in the desired position relative to the crevices of the bowling alley.

It should be understood that the device in accordance with the present invention, with regard to both of the above-described embodiments, may be selectively applied to either one particular one or both of the bowler's shoes. For example, a right-handed bowler may prefer to have the device provided on his right shoe and a left-handed bowler on his left shoe. In the embodiment of the invention shown in FIGS. 1–5, the bowling shoes may be manufactured as a pair with the device according to the invention provided on both shoes. In the embodiment shown in FIGS. 6–11, the bowler may selectively apply guide strip 9 to either his right or left bowling shoe, as desired.

Although there have been described what are at present considered to be the preferred embodiments of the invention, it will be understood that various modifications may be made therein and the invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

I claim:

1. A bowling shoe guide device comprising:

first and second sighting arrow members disposed adjacent the upper forward portion of a bowling shoe;

said first and second sighting arrow members being disposed substantially parallel to the longitudinal axis of said bowling shoe;

the heads of said sighting arrow members being directed towards and terminating adjacent the forward upper tip of said bowling shoe; and said first and second sighting arrow members being relatively spaced apart a distance substantially equal to the standard distance between a pair of adjacent crevices defined between the longitudinal boards which form the floor of a conventional bowling alley.

2. A bowling shoe guide device in accordance with claim 1, wherein:

said device further includes a third sighting arrow member which is disposed substantially adjacent to the center line of said upper forward portion of said bowling shoe; and said first and second sighting arrow members are disposed symmetrically with respect to said third sighting arrow member and relative to said center line of said upper forward portion of said bowling shoe.

3. A bowling shoe guide device in accordance with claim 2, wherein:

said bowling shoe includes a substantially square toe portion formed by a substantially flat forward tip surface disposed substantially perpendicular to the longitudinal axis of said bowling shoe.

4. A bowling shoe guide device in accordance with claim 3, wherein:

said sighting arrow members are integrally permanently formed in said upper forward portion of said bowling shoe.

5. A bowling shoe guide device in accordance with claim 4, wherein:

said sighting arrow members are fabricated of a material having a contrasting color to the material of which said upper forward portion of said bowling shoe is fabricated.

6. A bowling shoe guide deivce comprising:

a plurality of sighting arrow members disposed adjacent to the upper forward portion of a bowling shoe;

each of said sighting arrow members being disposed substantially parallel to the longitudinal axis of said bowling shoe;

the heads of said sighting arrow members being directed towards and terminating adjacent the forward upper tip of said bowling shoe;

first and second ones of said sighting arrow members being relatively spaced apart a distance substantially equal to the distance between adjacent crevices formed between the longitudinal boards of a conventional bowling alley;

a third one of said sighting arrow members being disposed substantially adjacent to the center line of said upper forward portion of said bowling shoe;

said first and second sighting arrow members being disposed symmetrically with respect to said third sighting arrow member and relative to said center line of said upper forward portion of said bowling shoe;

a guide strip, said guide strip being adapted to be removably secured adjacent said upper forward portion of said bowling shoe; and said sighting arrow members being disposed on the upper visible surface of said guide strip such that said third arrow member is disposed substantially adjacent to the center line of said upper forward portion of said bowling shoe.

7. A bowling shoe guide device in accordance with claim 6, wherein:

the lower surface of said guide strip is provided with adhesive means for securing said guide strip adjacent said upper forward portion of said bowling shoe.

8. A bowling shoe guide device in accordance with claim 6, wherein:

said guide strip is provided with a central fold line to permit said guide strip to be folded into a right-angular configuration, including a substantially horizontal portion and a substantially vertical portion;

said sighting arrow members being disposed on the upper visible surface of said horizontal portion of said guide strip;

said horizontal portion of said guide strip being adapted to be secured adjacent said upper forward portion of said bowling shoe; and said vertical portion of said guide strip being adapted to be secured adjacent said substantially flat forward tip surface of said bowling shoe.

9. A bowling shoe guide device in accordance with claim 8, wherein:

said sighting arrow members are fabricated of a material having a contrasting color to the material of which said guide strip is fabricated.

10. A bowling shoe guide device in accordance with claim 6, wherein:

said bowling shoe includes a substantially square toe portion formed by a substantially flat forward tip surface disposed substantially perpendicular to the longitudinal axis of said bowling shoe.

* * * * *